US005197871A

United States Patent [19]

Yamamoto et al.

[11] Patent Number: 5,197,871

[45] Date of Patent: Mar. 30, 1993

[54] VAPORIZING TYPE BURNER

[75] Inventors: Yuuzou Yamamoto, Yaita; Katsuji Sawada, Tochigi; Hisashi Fukunaga, Yaita, all of Japan

[73] Assignee: Mikuni Kogyo Kabushiki Kaisha, Japan

[21] Appl. No.: 903,763

[22] Filed: Jun. 25, 1992

[30] Foreign Application Priority Data

Aug. 6, 1991 [JP] Japan ..... 3-219399

[51] Int. Cl.[5] ..... F23Q 7/08

[52] U.S. Cl. ..... 431/262; 431/326; 126/110 B; 126/116 R

[58] Field of Search ..... 431/326, 261, 262, 327; 126/96, 110 B, 95, 116 R; 237/12.3 C

[56] References Cited

U.S. PATENT DOCUMENTS

| | | | |
|---|---|---|---|
| 3,086,579 | 4/1963 | Brown | 431/262 |
| 3,531,229 | 9/1970 | Berglund | 431/262 |
| 4,471,754 | 9/1984 | Galtz | 237/12.3 C X |
| 4,530,658 | 7/1985 | Panick | 237/12.3 C X |
| 4,538,985 | 9/1985 | Zwicker | 431/262 |
| 5,020,991 | 6/1991 | Schaale et al. | 431/262 X |
| 5,056,501 | 10/1991 | Ida | 431/262 X |
| 5,090,896 | 2/1992 | Kenner | 431/262 |

FOREIGN PATENT DOCUMENTS 59-60109 4/1984 Japan .

*Primary Examiner*—Larry Jones
*Attorney, Agent, or Firm*—Lorusso & Loud

[57] ABSTRACT

A vaporizing type burner including a cylindrical body, a combustion chamber, a fuel absorbing section for receiving a fuel therein and vaporizing the received fuel therefrom, a mixer tube in which a vaporized fuel and a combustion air are mixed with each other to prepare a mixture gas and an igniting plug for igniting the mixture gas radially ejected from the mixer tube wherein a supporting member for accommodating the fuel absorbing section in the cylindrical body is arranged in such a manner as not to allow the fuel absorbing section to be exposed directly the combustion chamber, a vaporizing chamber is arranged adjacent to the fuel absorbing section and the supporting member so as to allow a part of the combustion gas generated in the combustion chamber to be introduced into the vaporizing chamber without any burning flame, an air swirling chamber includes a plurality of guide plates for imparting a swirling force to the combustion air, the mixer tube is communicated not only with the air swirling chamber but also with the vaporing chamber while forming a mixing passage therein, and a number of ejection holes are formed over the outer surface of the mixer tube to radially eject the mixture gas therethrough is disclosed. The mixer tube may include an inner tube having a number of holes formed thereon to define an uniform pressure space therebetween.

8 Claims, 2 Drawing Sheets

VAPORIZING TYPE BURNER

BACKGROUND OF THE INVENTION

1. Field of the Invention

The present invention relates to a vaporizing type burner preferably employable for a heating unit such a heater for a vehicle, a heater for a ship, a multi-purposed portable type heater or the like.

2. Description of the Related Art

In general, a vehicle or a ship is equipped with a vaporizing type burner(s) for the purpose of heating, as disclosed in, e.g., Japanese Unexamined Publication Patent (Kokai) NO. 59-60109. According to this prior invention, the conventional vaporizing type burner includes a cylindrical body in which a combustion chamber is formed such that a fuel absorbing section is arranged directly in the combustion chamber or the former is located opposite to the latter in order to produce a fuel vapor by vaporizing a fuel from the fuel absorbing section. On the other hand, an air inflow hole is formed on a wall surface of cylindrical the body for the purpose of inflow of a combustion air therethrough so that the combustion air introduced into the combustion chamber and the fuel vapor generated from the fuel absorbing section are mixed with each other in the combustion chamber thereby to produce a mixture gas consisting of the fuel vapor and the combustion air. The resultant mixture gas is ignited by activating an igniting plug.

Since the conventional vaporizing type burner is constructed such that the fuel vapor and the combustion air are introduced into the combustion chamber from separate positions, there arise inconveniences that it is difficult to completely mix the combustion vapor with the fuel vapor, and moreover, it is also difficult to properly determine the position where the inflow hole is to be formed on the wall surface of the cylindrical body, resulting in satisfactory combustion failing to be achieved.

In addition, since the fuel absorbing section is arranged in the combustion chamber, a residual product derived from combustion of the mixture gas in the combustion chamber is increasingly deposited on the fuel absorbing section as time elapses. This leads to the result that a fuel is imperfectly vaporized and incorrect combustion is liable to take place. Similarly, the residual product is deposited on a coil type ignition plug which is arranged in a protruded state in the combustion chamber, causing wire disconnection or thermal wire damage to occur. As a result, there often arises an occasion that the heater can not be put in practical use.

SUMMARY OF THE INVENTION

The present invention has been made with the foregoing background in mind.

An object of the present invention is to provide a vaporizing type burner which assures that few residual material is adhesively deposited on a fuel absorbing section, a heater and associated components after a combustion gas is generated.

Other object of the present invention is to provide a vaporizing type burner which assures a long running life and an improved combustion efficiency by previously preparing a mixture gas consisting of a fuel and a combustion air and burning it in a combustion chamber in the satisfactorily mixed state with an elongated distance of displacement of the mixture gas.

Another object of the present invention is to provide a vaporizing type burner which is constructed in smaller dimensions.

According to one aspect of the present invention, there is provided a vaporizing type burner wherein a fuel contained in a fuel absorbing section is vaporized, the vaporized fuel is mixed with a combustion air to prepare a mixture gas and the resultant mixture gas is then ignited by activating an igniting plug in a combustion chamber defined by a cylindrical body, wherein the vaporizing type burner further includes a supporting member for accommodating the fuel absorbing section in the cylindrical body in such a manner as not to allow the fuel absorbing section to be exposed directly to the combustion chamber, the supporting member having a heat receiving plate arranged at the fore end of the fuel absorbing section, the heat receiving plate being exposed to the combustion chamber; a vaporing chamber arranged adjacent to the fuel absorbing section and the supporting member exclusive of the heat receiving plate while establishing communication with the combustion chamber so as to allow a part of the combustion gas generated in the combustion chamber to be introduced into the vaporizing chamber without any burning flame; an air swirling chamber including means for imparting a swirling force to the combustion air; a mixer tube communicated not only with the air swirling chamber but also with the vaporizing chamber while forming a mixing passage therein, the mixer tube being protruded into the combustion chamber; and a number of ejection holes formed over the outer surface of the mixer tube in the region protruded into the combustion chamber from the heat receiving plate to establish communication between the mixing passage and the combustion chamber; whereby the fuel is vaporized from the fuel absorbing section by the heat of the combustion gas thermally conducted via the heat receiving plate and the heat derived from a part of the combustion gas introduced into the vaporizing chamber, the vaporized fuel and the swirling combustion air are mixed with each other in the mixing passage, the resultant mixture gas is radially ejected into the combustion chamber through the ejection holes, and the ejected mixture gas is then ignited by activating the igniting plug to form plural arrays of burning flames.

To assure proper operation of the vaporizing type burner, a communication passage is formed between the inner wall surface of the cylindrical body and the outer wall surface of the supporting member so as to allow a part of the combustion gas to be circulated into the mixing passage via the communication passage and the vaporizing chamber wherein one end of the communication passage is communicated with the combustion chamber and other end of the same is communicated with the vaporizing chamber.

The fuel absorbing section is exposed to the vaporizing chamber, and the fuel vaporized from the fuel absorbing section is introduced into the mixing passage of the mixer tube via the vaporizing chamber.

A cross-sectional area of an outlet port of the air swirling chamber is determined to be smaller than that of the mixing passage of the mixture tube.

In addition, the igniting plug is constructed in the form of a rod-shaped glow plug including a heating portion wherein the glow plug extends through the fuel absorbing section to heat the fuel absorbing section while the foremost end of the glow plug is located in the combustion chamber.

Further, according to other aspect of the present invention, there is provided a vaporizing type burner of the foregoing type, wherein the mixer tube includes an inner tube having a number of holes formed thereon to define an uniform pressure space therebetween while it is communicated not only with an air swirling chamber via the inner tube but also with a vaporing chamber while forming a mixing passage therein, and moreover, it is protruded into the interior of a combustion chamber.

The holes on the inner tube are positionally offset from the ejection holes on the mixer tube not only in the radial direction but also in the longitudinal direction of the mixer tube.

Furthermore, according to another aspect of the present invention, there is provided a vaporizing type burner of the foregoing type, wherein the fuel absorbing section is covered with a heat receiving plate, a supporting member and a sealing plate located opposite to a vaporizing chamber while establishing communication between the fuel absorbing section and a mixture tube through a plurality of communication holes formed on the mixer tube so as to allow the fuel vaporized from the fuel absorbing section to be introduced into a mixing passage of the mixer tube through the communication holes to prepare a mixture gas.

Other objects, features and advantages of the present invention will become apparent by reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
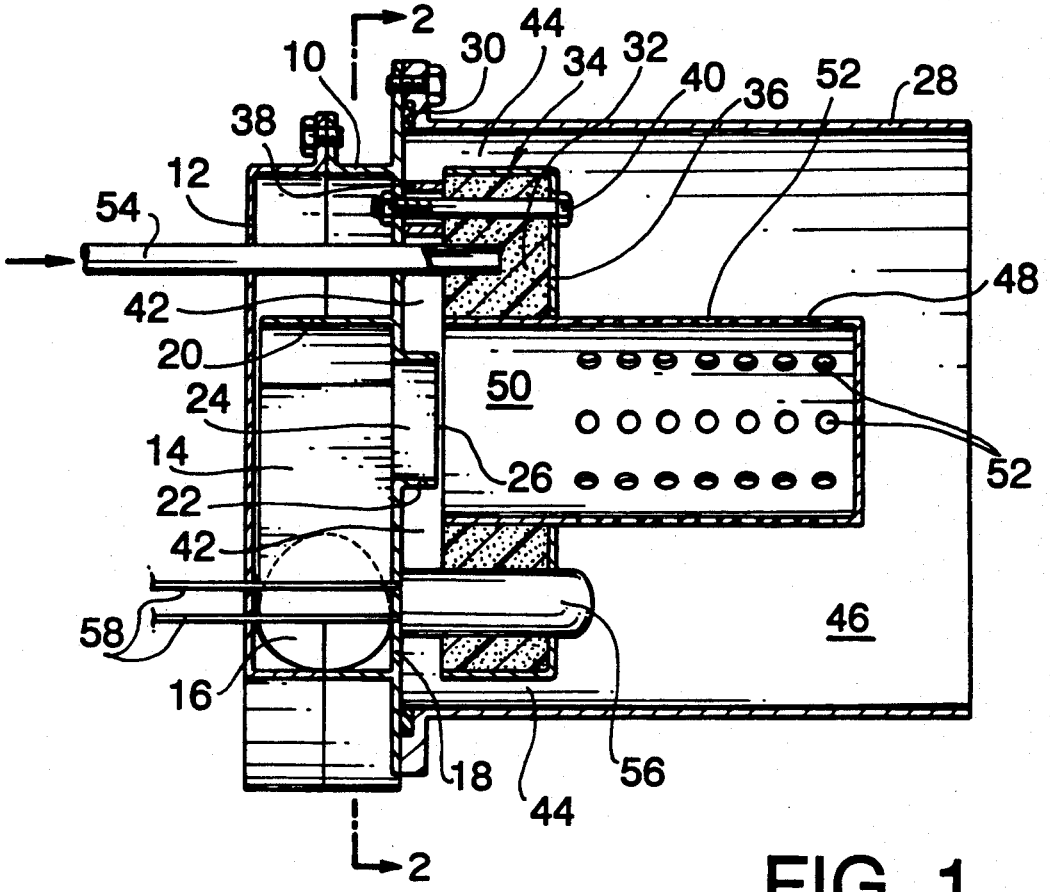
FIG. 1 is a sectional view of a vaporizing type burner in accordance with a first embodiment of the present invention.
Figure 2:
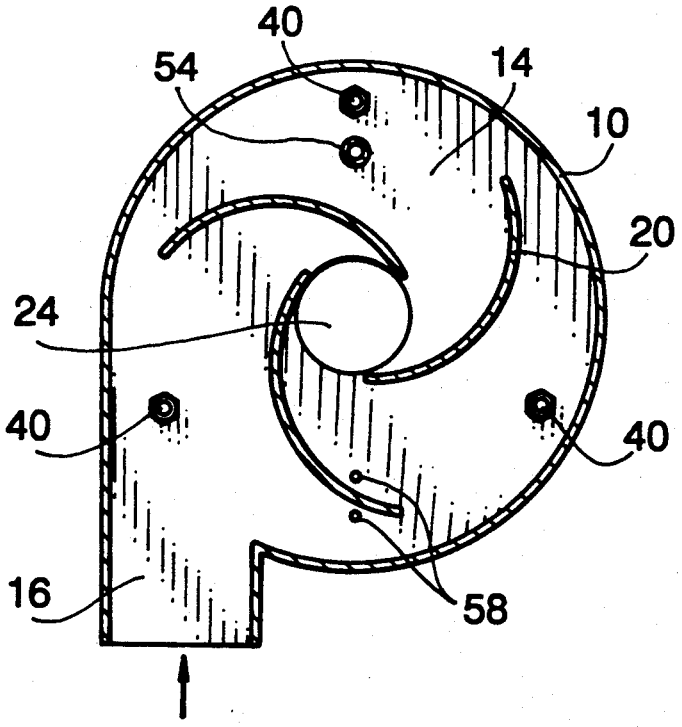
FIG. 2 is an enlarged cross-sectional view of the vaporizing burner taken along line A—A in FIG. 1.

FIG. 1 is a sectional view of a vaporizing type burner in accordance with a first embodiment of the present invention, and FIG. 2 is an enlarged cross-sectional view of the burner taken along line A—A in FIG. 1.

The burner includes a casing 1 and a cover 12 both of which define an air swirl flow chamber 14. In addition, the casing 10 includes an air inlet port 16 through which a combustion air is introduced into the air swirl flow chamber 14. A plurality of arc-shaped guide plates 20 are fixedly secured to a wall plate 18 of the casing 10 in the air swirl flow chamber 14.

As is best seen in FIG. 2, each of the guide plates 20 is configured such that inflow of the air through the inlet port 16 is oriented toward the central part of the air swirl flow chamber 14 along the respective guide plates 20. A short cylindrical member 22 projecting away from the guide plates 20 is made integral with the wall plate 18 at the central part of the same in such a manner that an air passage 24, i.e, the inner space of the cylindrical member 22 is communicated with the air swirl flow chamber 14 so as to allow the combustion air introduced into the air passage 24 from the air swirl flow chamber 14 to be blown out through an outlet port 26.

A cylindrical body 28 of which opposite ends are opened and exposed to the outside is attached to the rear surface of the wall plate 18 relative to the guide plates 20 with a sealing material 30 interposed therebetween. As is apparent from FIG. 1, the wall plate 18 of the casing 10 serves as an end surface of the cylindrical body 28 on the left-hand side of the same. A supporting member 34 including a fuel absorbing section 32 is attached to the wall plate 18 in the spaced relationship while a certain amount of gap is held therebetween. Specifically, the supporting member 34 is designed in the cylindrical configuration such that one end of the supporting member 34 is closed with a plate 36 and other end of the same is opened and exposed to the wall plate 18. As is apparent from FIG. 1, the closed surface of the supporting member 34, i.e., the plate 36 serves as a heat receiving plate which is spaced away from the wall plate 18. The fuel absorbing section 32 is molded of a ceramic material or made of a metallic material in such a manner that it is surrounded by the supporting member 34 and accommodated in the same while it is located opposite to the wall plate 18 in the spaced relationship relative to the same. A spacer 38 is interposed between the fuel absorbing section 32 and the wall plate 18, and the fuel absorbing section 32 and the supporting member 34 are immovably secured to the wall plate 18 by tightening a plurality of bolts 40. The spacer 38 serves to provide a gap between the wall plate 18 and the fuel absorbing section 32 inclusive of the supporting member 34 so as to form a vaporizing chamber 42 defined by the hollow space of the foregoing gap.

The supporting member 34 and the cylindrical body 28 are arranged such that the axis of the supporting member 34 positionally coincides with the axis of the cylindrical body 28, resulting in an annular gap being formed between the outer wall of the supporting member 34 and the inner wall of the cylindrical body 28. The foregoing annular gap serves as a communication passage 44 which is communicated with the vaporizing chamber 42. In other word, the inner space of the cylindrical body 28 of which one end is closed with the wall plate 18 consists of a combustion chamber 46 to which the heat receiving plate 36 of the supporting member 34 is exposed, the communication passage 44 communicated with the combustion chamber 46 and the vaporizing chamber 42 communicated with the communication passage 44. Since the cylindrical body 28 is constructed in the above-described manner, the vaporizing chamber 42 is not exposed directly to the combustion chamber 46.

A mixer tube 48 of which one end is closed with a plate and which has a diameter smaller than that of the supporting member 34 horizontally extends through the central part of the heat receiving section 36 in the supporting member 34 while it is immovably supported by the supporting member 34. The open end of the mixer tube 48 is located opposite to the wall plate 18 in such a manner that the foremost end of the mixer tube 48 on the open end side is flush with the open end surface of the supporting member 34 or is slightly protruded toward the wall plate 18. In addition, a center axis of the mixer tube 48 positionally coincides with a center axis of the cylindrical member 22, and an inner diameter of the mixer tube 48 is dimensioned to be larger than an outer diameter of the cylindrical member 22. It is desirable that the right-hand open end of the cylindrical member 22 is not located inward of, i.e., rightward of the left-hand open end of the mixer tube 48 as seen in FIG. 1. A mixing passage 50 that is an inner hollow space of the mixer tube 48 is communicated with the vaporizing chamber 42 via a gap between the left-hand open end of the mixer tube 48 and the right-hand end of the cylindrical member 22, It should be noted that the right-hand end of the cylindrical member 22, i.e., an outlet port 26 of the same may be located inside of, i.e., rightward of the open end of the mixer tube 48. The front surface of the mixer tube 48 is sufficiently projected into the interior of the cylindrical body 28, i.e., a combustion chamber 46 away from the heat receiving plate 36 of the supporting member 34, and a number of ejection holes 52 each serving as a burning flame port are formed round the outer surface of the mixer tube 48.

The vaporizing type burner is provided with a fuel supply tube 54 of which open end is located at the middle part of the fuel absorbing section 32 while extending through the cover 12 and the casing 10. This is intended to continuously supply a fuel into the fuel absorbing section 32 through the fuel supply tube 54. A glow plug 56 serving as an ignition plug with its full length is disposed in the combustion chamber 46 on the opposite side relative to the guide plates 20 on the wall plate 18, and the foremost end of the glow lamp 56 is projected in the combustion chamber 46 through the vaporizing chamber 42, the fuel absorbing section 32 and the wall plate 18. As is apparent from FIG. 1, the glow plug 56 is located in the vicinity of the mixer tube 48 while extending in parallel with the same. The glow plug 56 has a pair of cables 58 which extend to the outside through the wall plate 18 of the casing 10 and the cover 12. The glow plug 56 serves not only to ignite the mixture gas ejected into the combustion chamber 46 through the ejection holes 52 but also to heat the fuel absorbing member 32. In general, the glow plug 56 consists of a ceramic material such as silicon nitride or the like and a tungsten wire embedded in the ceramic material. However, the structure of the glow plug 56 should not be limited only to the aforementioned one but it may be constructed to have another modified structure.

Next, operation of the vaporizing type burner constructed in the above-described manner will be described below.

As an air is introduced into the air swirl chamber 14 via the air inlet port 16, it is collected at the central part of the air swirl flow chamber 14 while swirling around the guide plates 20. Subsequently, the air spirally enters the air passage 24 in the cylindrical member 22 and it is then blown in the mixing passage 50 of the mixer tube 48 while maintaining the swirling flow state. On the other hand, a fuel is continuously supplied into the fuel absorbing section 32 through the fuel supply tube 54. When the fuel is to be ignited, the fuel absorbing section 32 is first heated by activating the glow plug 56, and the fuel filled in the fuel absorbing section 32 is then thermally vaporized. The vaporized fuel overflows in the vaporizing chamber 42. As the swirling air serving as a combustion air flows into the mixing passage 50 in the mixer tube 48 through the outlet port 26, a suction phenomenon appears, causing the vaporized fuel in the vaporizing chamber 42 to be forcibly introduced into the mixing passage 50. As a result, the combustion air and the vaporized fuel are mixed with each other in the mixing passage 50 of the mixer tube 48. At this time, since the combustion air is introduced into the mixing passage 50 in the swirling state, the combustion air and the vaporized fuel are satisfactorily mixed with each other in the mixing passage 50. Subsequently, the mixture gas which has been subjected to sufficient mixing in the mixer tube 48 is radially ejected into the combustion chamber 46 through the ejection holes 52 on the mixing tube 48.

The mixture gas which has been ejected into the combustion chamber 46 is ignited immediately by activating the glow plug 56 located just adjacent to the mixer tube 48. In contrast with the conventional vaporizing type burner in which a combustion air and a fuel are separately introduced into a combustion chamber so that a burning flame is generated at the position where the combustion air and the vaporized fuel are mixed with each other, according to the present invention, a mixture gas is previously prepared with a combustion air and a fuel in the mixer tube 48 so that the resultant mixture gas is then ejected into the combustion chamber 46. Thus, plural array of burning flames are generated immediately after the mixture gas has been ejected in that way, in such a manner that an array of radially extending flames are formed in the combustion chamber 46. As a result, a length of the combustion chamber 46 can be shortened compared with the conventional vaporizing type burner.

The heat receiving plate 36 of the supporting member 34 is heated by the combustion gas generated by combustion of the mixture gas in the combustion chamber, whereby the fuel absorbing section 32 is heated by thermal conduction of the heat from the heat receiving plate 36. On the other hand, a part of the combustion gas generated in the combustion chamber 46 enters the vaporizing chamber 42 through a communication passage 44 between the outer cylindrical wall of the supporting member 34 and the inner cylindrical wall of the body 28 so that a part of the fuel absorbing section 32 exposed to the air vaporizing chamber 42 is heated by the combustion gas. Since no oxygen is present in the communication chamber 44 and the vaporizing chamber 42, the burning flame of the combustion gas which has been ignited in the combustion chamber 46 disappears when it enters the communication passage 44. Thus, there is no possibility that the fuel vaporized in the fuel absorbing section 32 is ignited by the combustion gas which has reached the vaporizing chamber 42.

It has been confirmed that the fuel absorbing section 32 is heated up to an elevated temperature in excess of 500° C. by the heat thermally conducted from the heat receiving plate 36, the combustion gas which has reached the vaporizing chamber 42 and the glow plug 56 extending through the same. Since the residual material remaining after completion of the combustion is liable to disappear when the fuel absorbing section 32 is heated up to the foregoing elevated temperature, few residual material adheres to the fuel absorbing section 32 during the combustion of the mixture gas The fuel which has been vaporized in the fuel absorbing section 32 flows in the mixing passage 50 together with the combustion gas which has reached the vaporizing chamber 42 under the influence of the suction phenomenon appearing as the combustion air flows into the mixing passage 50 through the outlet port 26 of the air passage 24. As a part of the combustion gas is circulated to the vaporizing chamber 42 located opposite to the fuel absorbing section 32 and the fuel absorbing section 32 is then heated by the circulated combustion gas, the supplied fuel is continuously vaporized in from fuel absorbing section 32.

Figure 3:
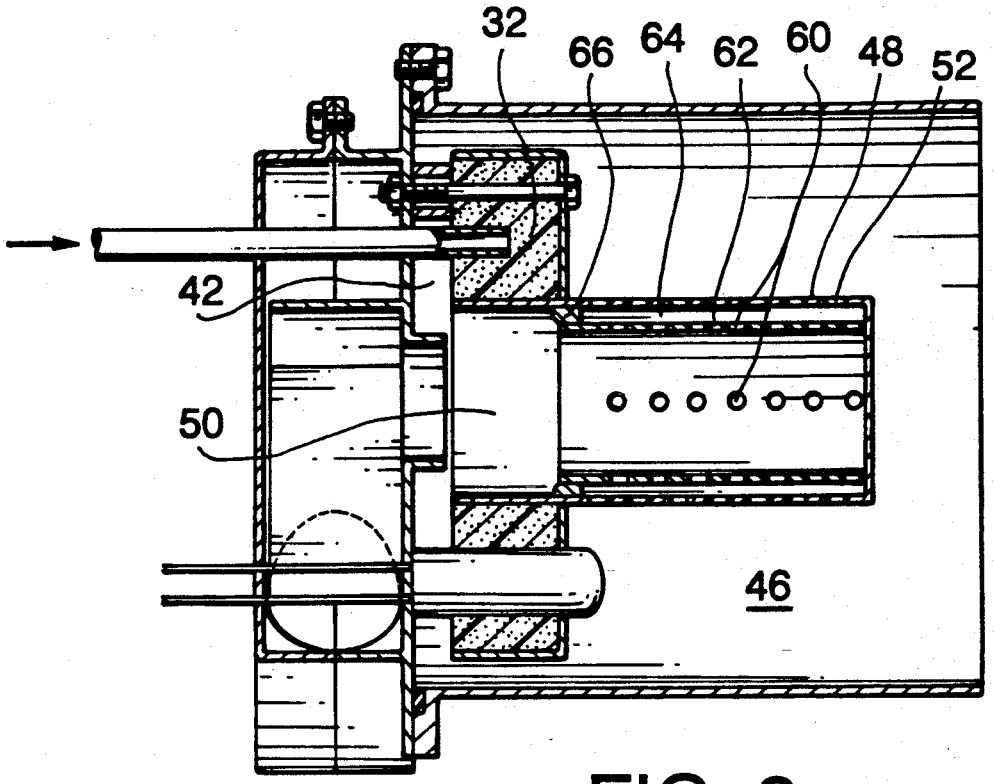
FIG. 3 is a sectional view of a vaporizing type burner in accordance with a second embodiment of the present invention.

Next, a vaporizing type burner in accordance with a second embodiment of the present invention will be described below with reference to FIG. 3. A point of difference of the vaporizing type burner shown in FIG. 3 from that shown in FIG. 1 consists in that a mixer tube 48 additionally includes an inner tube 62 having a number of holes 60 formed thereon, whereby a double-layered structure is built by the mixer tube 48 and the inner tube 62. With the double-layered structure as mentioned above, an annular uniform pressure space 64 is formed between the mixer tube 48 and the inner tube 62. It should be noted that the holes 60 on the inner tube 62 are arranged such that they are positionally offset from a number of ejection holes 52 on the mixer tube 48 not only in the radial direction but also in the longitudinal direction of the mixer tube 48. A sealing member 66 is interposed between the outer wall surface of the inner tube 62 and the inner wall surface of the mixer tube 48 at the position substantially coinciding with the heat receiving plate 36 of the fuel absorbing section 32. The arrangement of the sealing member 66 in that way assures that a mixing passage 50 in the mixer tube 48 is communicated with the uniform pressure chamber 64 only through the holes 60 on the inner tube 62.

Since the vaporizing type burner in accordance with the second embodiment of the present invention is constructed in the above-described manner, the mixture gas which has been introduced into the mixing passage 50 of the mixer tube 48 is ejected into the combustion gas 46 through the ejection holes 52 on the mixer tube 48 via the holes 60 on the inner tube 62 and the uniform pressure space 64. Since the mixture gas is ejected into the combustion chamber 46 via the holes 60 on the inner tube 60 and the uniform pressure space 64 in that way, it can be ejected through the injection holes 52 at a constant ejecting speed. In addition, the mixture gas which has been introduced into the the mixing passage 50 of the mixer tube 48 is subjected to sufficient mixing and stirring not only in the mixing passage 50 but also in the uniform pressure space 64 until it is ejected into the combustion chamber 46 through the ejection holes 52.

Figure 4:
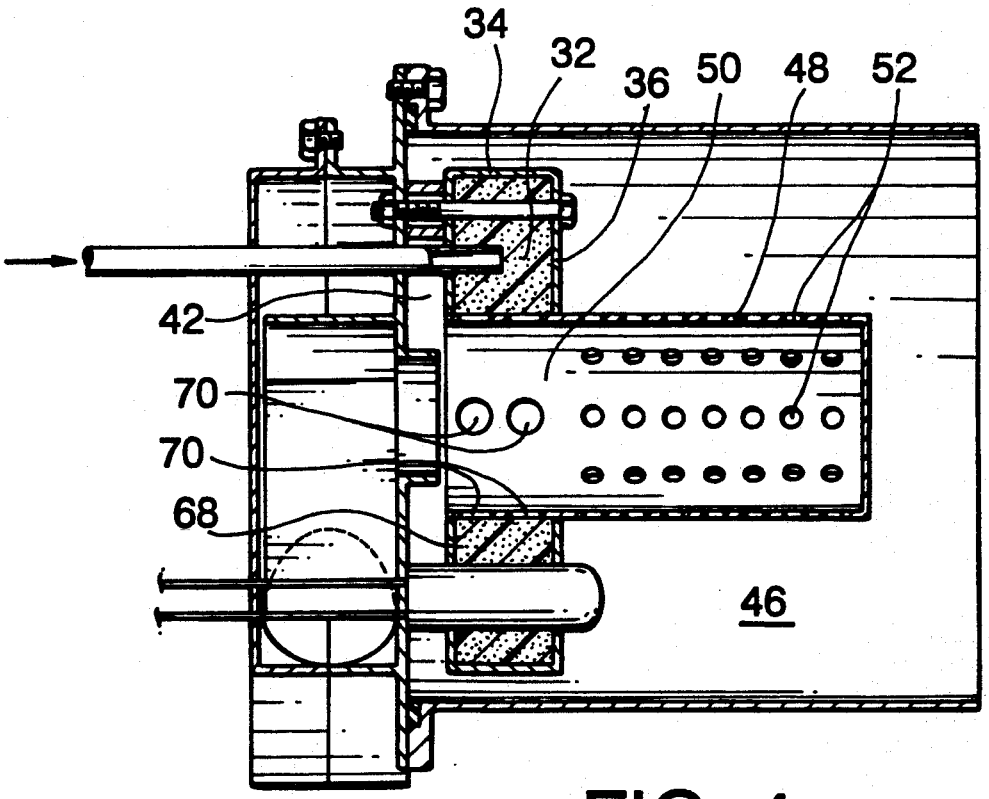
FIG. 4 is a sectional view of a vaporizing type burner in accordance with a third embodiment of the present invention.

Next, a vaporizing type burner in accordance with a third embodiment of the present invention will be described below with reference to FIG. 4. A point of difference of the vaporizing type burner shown in FIG. 4 from that shown in FIG. 1 consists in that a part of the fuel absorbing section 32 located on the vaporizing chamber 42 side is covered with a sealing plate 68 in order to avoid direct exposure of the fuel absorbing section 32 to the vaporizing chamber 42. In addition, a plurality of communication holes 70 are formed on the mixer tube 48 to establish communication between the fuel absorbing section 32 and the mixer tube 48.

With the vaporizing type burner constructed as described above, the fuel absorbing section 32 is heated by thermal conduction of the heat received by the heat receiving plate 36 of the supporting member 34 as well as thermal conduction of the heat received by the sealing plate 68 exposed to the combustion gas introduced into the vaporizing chamber 42. Since the fuel absorbing section 32 is fully covered with the supporting member 34, the heat receiving plate 36 and the sealing plate 68, there is no possibility that a residual product derived from combustion in the combustion chamber 46 is deposited on the fuel absorbing section 32. The vaporized fuel generated from the heated fuel absorbing section 32 is introduced directly into the mixer tube 50 through the communication holes 70 so that it is sufficiently mixed in the mixing passage 50 with the combustion air introduced through the outlet port 26.

As is apparent from the above description, with the vaporizing type burner constructed according to the present invention, a mixture gas is radially ejected through a number of ejection holes on the mixer tube so that it is immediately ignited in the combustion chamber with the aid of the glow plug. In other words, the vaporizing type burner tube serves as a cylindrical burner having a number of ejection holes formed thereon to generate an array of radially extending flames in the combustion chamber. Consequently, a length of the vaporizing type burner can be dimensioned depending on a length of each of the combustion chamber and a heat exchanger. In addition, the total length of the vaporizing type burner can be shortened compared with the conventional cylindrical burner which is constructed to inject a mixture gas in the axial direction.

In addition, since the fuel absorbing section is not influenced directly by the burning flames generated in the combustion chamber, few residual product derived from combustion in the combustion camber is deposited on the fuel absorbing section, resulting in a running life of the vaporizing type burner being substantially elongated. Additionally, since the fuel absorbing section is heated by the heat thermally conducted from the heat receiving plate of the supporting member, the heat obtained from a part of the combustion gas circulatively introduced into the vaporizing chamber without any burning flame and the heat generated from the glow plug, the residual combustion product is hardly deposited on the fuel absorbing section while the fuel absorbing section is maintained at an elevated temperature. This lead to the result that a running life of the vaporizing type burner can be elongated remarkably.

Since the combustion air kept in a swirled state and the vaporized fuel are sufficiently mixed with each other in the mixing passage, a mixture gas can be prepared in the mixer tube in an optimum manner. In addition, since the vaporized fuel and the combustion air are previously mixed in the mixing chamber and the resultant mixture gas is radially ejected into the combustion chamber, combustion can be accomplished in the combustion chamber at an improved efficiency.

In contrast with the conventional vaporizing type burner, there is no need of arranging a cylindrical chamber outside of the combustion chamber for the purpose of introducing a combustion air, resulting in the cylindrical body being dimensioned to have a smaller diameter. Since the glow plug is arranged in parallel with a combustion sleeve, an inner tube and an outer sleeve while extending through a partition for the combustion sleeve, the vaporizing type burner can be constructed in simple structure at a reduced cost compared with the conventional vaporizing type burner having a glow plug extending through a combustion sleeve, an inner tube and an outer sleeve.

When the glow plug is designed in a rod-shaped configuration so as to generate heat across the whole length thereof for the purpose of ignition, the fuel vaporizing section can be heated directly by the glow plug. This leads to the result that fuel vaporization can positively be promoted with a reduced quantity of electricity consumed for ignition.

Since a number of ejection holes are dispersively formed on the mixture tube, generation of a noisy sound can remarkably be suppressed compared with the conventional vaporizing type burner. When the mixer tube additionally includes an inner tube having a number of holes formed thereon, the mixture gas prepared in the mixer tube can be ejected into the combustion chamber not only at an uniform ejection speed but also at an increased combustion efficiency.

While the present invention has been described above with respect to a few preferred embodiments thereof, it should of course be understood that the present invention should not be limited only to these embodiments but various changes or modifications may be made without departure from the scope of the present invention as defined by the appended claims.

What is claimed is:

1. In a vaporizing type burner wherein a fuel contained in a fuel absorbing section is vaporized, the vaporized fuel is mixed with a combustion air to prepare a mixture gas and the resultant mixture gas is then ignited by activating an igniting plug in a combustion chamber defined by a cylindrical body, the improvement comprising;

a supporting member for accommodating said fuel absorbing section in said cylindrical body in such a manner as not to allow said fuel absorbing section to be exposed directly to said combustion chamber, said supporting member having a heat receiving plate arranged at the fore end of said fuel absorbing section, said heat receiving plate being exposed to said combustion chamber, a vaporizing chamber arranged adjacent to said fuel absorbing section and said supporting member exclusive of said heat receiving plate while establishing communication with said combustion chamber so as to allow a part of the combustion gas generated in said combustion chamber to be introduced into said vaporizing chamber without any burning flame, an air swirling chamber including means for imparting a swirling force to said combustion air, a mixer tube communicated not only with said air swirling chamber but also with said vaporing chamber while forming a mixing passage therein, said mixer tube being protruded into said combustion chamber, and a number of ejection holes formed over the outer surface of said mixer tube in the region protruded into said combustion chamber from said heat receiving plate to establish communication between said mixing passage and said combustion chamber, whereby said fuel is vaporized from said fuel absorbing section by the heat of the combustion gas thermally conducted via said heat receiving plate and the heat derived from a part of the combustion gas introduced into said vaporizing chamber, the vaporized fuel and the swirling combustion air are mixed with each other in said mixing passage, the resultant mixture gas is radially ejected into said combustion chamber through said ejection holes, and the ejected mixture gas is then ignited by activating said igniting plug to form plural array of burning flames.

2. The vaporizing burner as claimed in claim 1, wherein a communication passage is formed between the inner wall surface of said cylindrical body and the outer wall surface of said supporting member so as to allow a part of the combustion gas to be circulated into said mixing passage via said communication passage and said vaporizing chamber, one end of said communication passage being communicated with said combustion chamber and other end of the same being communicated with said vaporizing chamber.

3. The vaporizing type burner as claimed in claim 1, wherein said fuel absorbing section is exposed to said vaporizing chamber, and the fuel vaporized from said fuel absorbing section is introduced into said mixing passage of said mixer tube via said vaporizing chamber.

4. The vaporizing type burner as claimed in claim 1, wherein a cross-sectional area of an outlet port of said air swirling camber through which a combustion air is blown into said mixing passage of said mixer tube from said air swirling chamber is determined to be smaller than that of said mixing passage of said mixer tube.

5. The vaporizing type burner as claimed in claim 1, wherein said igniting plug is constructed in the form of a rod-shaped glow plug including a heating portion, said glow plug extending through said fuel absorbing section to heat said fuel absorbing section, the foremost end of said glow plug being located in said combustion chamber.

6. In a vaporizing type burner wherein a fuel contained in a fuel absorbing section is vaporized, the vaporized fuel is mixed with a combustion air to prepare a mixture gas and the resultant mixture gas is then ignited by activating an ignition plug in a combustion chamber defined by a cylindrical body, the improvement comprising;

a supporting member for accommodating said fuel absorbing section in said cylindrical body in such a manner as not to allow said fuel absorbing section to be exposed directly to said combustion chamber, said supporting member having a heat receiving plate arranged at the fore end of said fuel absorbing section, said heat receiving plate being exposed to said combustion chamber, a vaporizing chamber arranged adjacent to said fuel absorbing section and said supporting member exclusive of said heat receiving plate while establishing communication with said combustion chamber so as to allow a part of the combustion gas generated in said combustion chamber to be introduced into said vaporizing chamber without any burning flame, an air swirling chamber including means for imparting a swirling force to said combustion air, a mixer tube means including an outer take and an inner take said inner tube having a number of holes formed thereon to define an uniform pressure space therebetween, said mixture tube being communicated not only with said air swirling chamber via said inner tube but also with said vaporizing chamber while forming a mixing passage therein, said mixer tube being protruded into said combustion chamber, a number of ejection holes formed over the outer surface of said mixture tube in the region protruded into said combustion chamber from said fuel absorbing section to establish communication between said mixing passage and said combustion chamber, whereby said fuel is vaporized from said fuel absorbing section by the heat of the combustion gas thermally conducted via said heat receiving plate and the heat derived from a part of the combustion gas introduced into said vaporizing chamber, the vaporized fuel and the swirling combustion air are mixed with each other in said mixing passage, the resultant mixture gas is radially ejected into said combustion chamber through said ejection holes, and the ejected mixture gas is then ignited by activating said igniting plug to form plural array of burning flames.

7. The vaporizing type burner as claimed in claim 6, wherein said holes on said inner tube are positionally offset from said ejection holes on said mixer tube not only in the radial direction but also in the longitudinal direction of said mixer tube.

8. In a vaporizing type burner wherein a fuel contained in a fuel absorbing section is vaporized, the vaporized fuel is mixed with a combustion air to prepare a mixture gas and the resultant mixture gas is then ignited by activating an igniting plug in a combustion chamber defined by a cylindrical body, the improvement comprising;

a supporting member for accommodating said fuel absorbing section in said cylindrical body in such a manner as not to allow said fuel absorbing section to be exposed directly to said combustion chamber, said supporting member having a heat receiving plate arranged at the fore end of said fuel absorbing section, said heat receiving plate being exposed to said combustion chamber, a vaporizing chamber arranged adjacent to said fuel absorbing section and said supporting member exclusive of said heat receiving plate while establishing communication with said combustion chamber so as to allow a part of the combustion gas generated in said combustion chamber to be introduced into said vaporizing chamber without any burning flame, said fuel absorbing section being covered with said heat receiving plate, said supporting member and a sealing plate located opposite to said vaporizing chamber while establishing communication between said fuel absorbing section and a mixer tube through a plurality of communication holes formed on said mixer tube so as to allow the fuel vaporized from said fuel absorbing section to be introduced into a mixing passage of said mixer tube through said communication holes to prepare a mixture gas, an air swirling chamber including means for imparting a swirling force to said combustion air, said mixer tube being communicated not only with said air swirling chamber but also with said vaporing chamber while forming said mixture passage therein, said mixture tube being protruded into said communication chamber, and a number of ejection holes formed over the outer surface of said mixer tube in the region protruded into said combustion chamber from said heat receiving plate to establish communication between said mixing passage and said combustion chamber, whereby said fuel is vaporized from said fuel absorbing section by the heat of the combustion gas thermally conducted via said heat receiving plate and the heat derived from a part of the combustion gas introduced into said vaporizing chamber, the vaporized fuel and the swirling combustion air are mixed with each other in said mixing passage, the resultant mixer gas is radially ejected into said combustion chamber through said ejection holes, and the ejected mixture gas is then ignited by activating said igniting plug to form plural arrays of burning flames.

* * * * *

UNITED STATES PATENT AND TRADEMARK OFFICE

CERTIFICATE OF CORRECTION

PATENT NO. : 5,197,871

DATED : March 30, 1993

INVENTOR(S) : YAMAMOTO et al

It is certified that error appears in the above-identified patent and that said Letters Patent is hereby corrected as shown below:

Column 10, line 56, delete "take" and insert --tube--;
line 57, delete "take" and insert --tube--.

Signed and Sealed this

Fourth Day of January, 1994

*Attest:*

Bruce Lehman

BRUCE LEHMAN

*Attesting Officer*

*Commissioner of Patents and Trademarks*